United States Patent [19]

Baldwin

[11] 4,081,159

[45] Mar. 28, 1978

[54] CONCRETE REINFORCEMENT

[75] Inventor: Ernest Baldwin, Sheffield, England

[73] Assignee: Tinsley Wire Industries Limited, Sheffield, England

[21] Appl. No.: 707,950

[22] Filed: Jul. 23, 1976

[30] Foreign Application Priority Data

Jul. 24, 1975 United Kingdom ..... 30951/75

[51] Int. Cl.[2] ..... B21F 27/20

[52] U.S. Cl. ..... 245/2; 245/7; 140/6; 140/24

[58] Field of Search ..... 140/6, 9, 105, 3 R, 140/4, 5, 24; 245/2, 7, 8

[56] References Cited

U.S. PATENT DOCUMENTS

| | | | |
|---|---|---|---|
| 435,042 | 8/1890 | Land | 140/105 |
| 735,842 | 8/1903 | Taylor | 140/105 |
| 902,198 | 10/1908 | Barlow | 140/24 |
| 1,061,432 | 5/1913 | Whittington | 140/9 |
| 1,270,129 | 6/1918 | Dwiggins | 140/6 |

*Primary Examiner*—Lowell A. Larson

*Attorney, Agent, or Firm*—Lowe, King, Price & Markva

[57] ABSTRACT

Reinforcement for concrete for covering pipes comprises wire netting with line wires extending through at least some of the twists of the netting and with at least some of the line wires crimped in at least some of the meshes of the netting across which they extend.

15 Claims, 7 Drawing Figures

CONCRETE REINFORCEMENT

This invention relates to concrete reinforcement, more particularly the reinforcement of concrete for covering pipes for use underwater, e.g. oil pipes on the sea bed, and has for its object the provision of heavy reinforcement readily capable of application to pipes by a continuous wrapping operation simultaneously with spraying concrete, so as to embed the reinforcement into the concrete.

According to the present invention, reinforcement for concrete for covering pipes comprises wire netting with line wires extending through at least some of the twists of the netting and with at least some of the line wires crimped in at least some of the meshes of the netting across which they extend.

The line wires increase the weight of the wire netting and therefore increase the concentration of reinforcement to be applied to a pipe, on a continuous basis, which is readily suited for incorporation in present pipe spraying equipment, and during application of the wire netting with crimped line wires to pipes the netting can be stretched, as by deflection by a roller or rollers, or merely by differential tensioning during wrapping so as to cause straightening of the crimps and elongation of the meshes towards one edge of the netting, whereby the edge of the netting becomes effectively longer than the other and can overlap the shorter edge in a preceding turn round a pipe without further straightening of the crimps or stressing of the wires.

The wire netting may be of the reverse twist type, in which case existing machinery will impose a limit on the size of line wires that can be incorporated, so it can be advantageous to use wire netting of the continuing twist type, the existing machinery for which does not impose any appreciable limit on the size of line wires that can be incorporated. However, any advantage in using wire netting of the continuous twist type is largely outweighed by the limited capacity of continuous twist machines, so it can — in fact — be more advantageous to accept the limit on the size of line wires that can be incorporated in a reverse twist machine because of its benefit of continuity of production.

In either case, the crimps are preferably formed in the line wires by deflecting the line wires between successive rows of longitudinally aligned twists after forming the leading row of twists and before forming the following row of twists, whereby with the line wires held in the leading row of twists the longer lengths of line wires that would be required than what would extend straight across the meshes are drawn into the mesh locations before the line wires become held in the following row of twists. The deflecting of the line wires is preferably in the plane of the wire netting, as it may then be effected by a series of tapering fingers carried by the beam of the machine that carries the twisting pinions into and out of engagement with the aligned mesh-forming wires, and the one series of fingers may be effective to deflect line wires in successive staggered rows of meshes because of the lateral movement of the beam between each series of twisting operations as the wire netting progresses intermittently. The crimps may all be identical, being formed by deflecting the line wires to the same extent, by fingers all having the same width at the positions of ultimate deflection of the line wires. Alternatively, the crimps may become progressively greater in extent across the width of the wire netting, being formed by corresponding deflection by fingers having different widths at the position of ultimate deflection of the line wires.

One edge of the wire netting is preferably provided with a straight selvedge wire (except, of course, for twists with the adjacent mesh-forming wire), which may be duplicated so as to add more weight of reinforcing wire. A straight (i.e., non-crimped) line wire may be provided through the full meshes adjacent the selvedge wire (or wires), so as to add further weight of reinforcing wire where no extending of the wire netting is still acceptable during the wrapping of the netting simultaneously with spraying concrete on to a pipe. Another line wire may be provided through the full meshes next-but-one to the selvedge wire (or wires) and may be allowed some slackness during formation of the netting so as to assume slight simulated crimps allowing of a little stretching of the netting at this location.

Also, in either case, the line wires can be of different quality metal to the wires twisted together to form the meshes, which is not possible with a welded mesh, where the wires have to be of a milder quality to facilitate speedy welding without embrittling the wires. Thus according to another feature of the present invention, the crimped line wires may be formed of higher tensile wire than the wires twisted together to form the meshes, so as to increase the strength of the reinforcement without a proportionate increase in weight.

The invention also includes a pipe with a concrete covering including reinforcement as defined above, and — in accordance with a further aspect of the invention — a method of manufacturing a composite steel and reinforced concrete pipe comprises rotating a steel pipe shell, continuously and helically winding around the shell wire netting with crimped line wires (as hereinbefore defined) and simultaneously spraying concrete on to shell so as to embed the wire netting into the concrete.

A number of embodiments of the invention and methods and means for making them will now be described, by way of example only, with reference to the accompanying drawings, in which.

Figure 1:
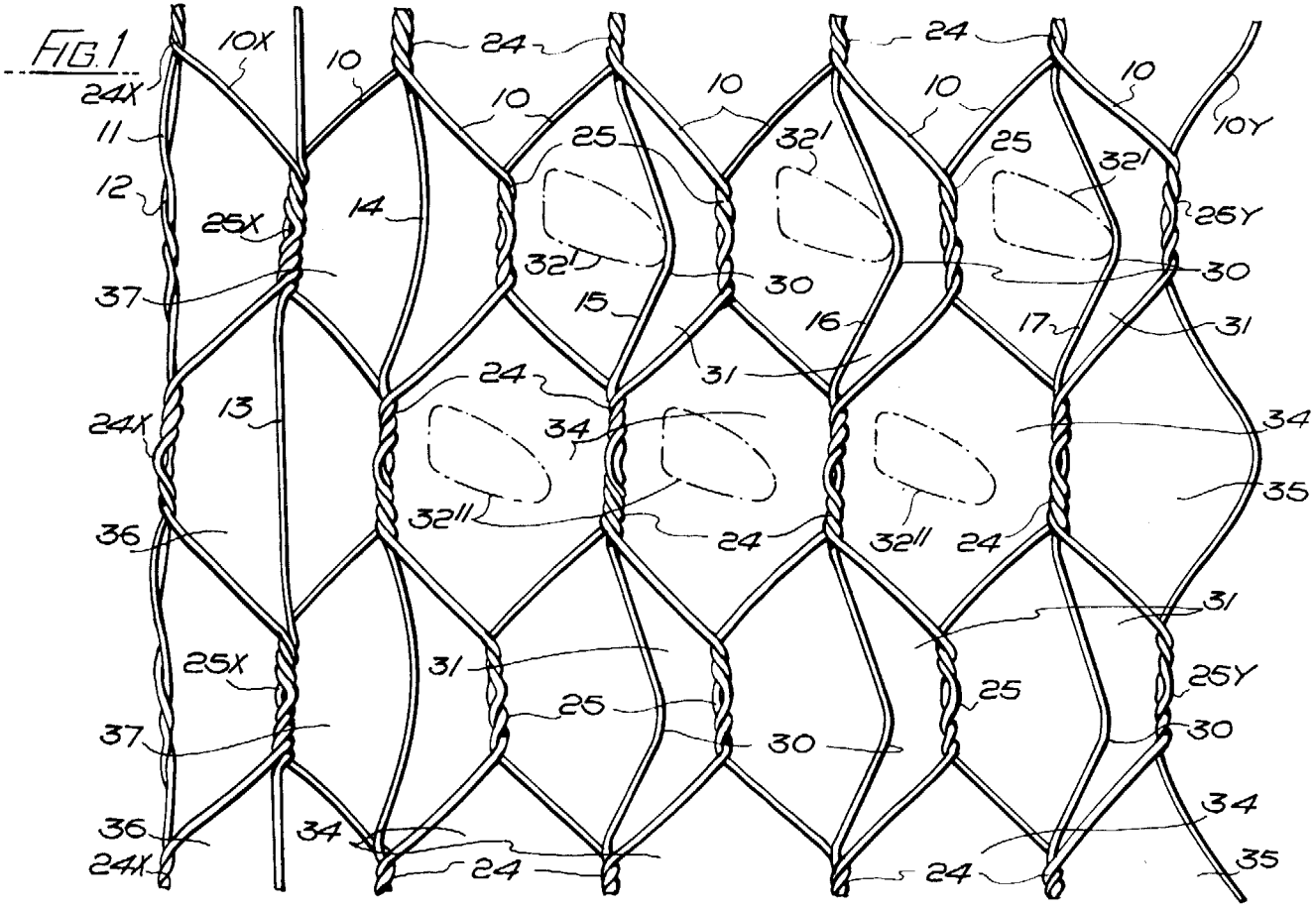
FIG. 1 is an elevation of a portion of a preferred form of wire netting in accordance with the invention.
Figure 6:
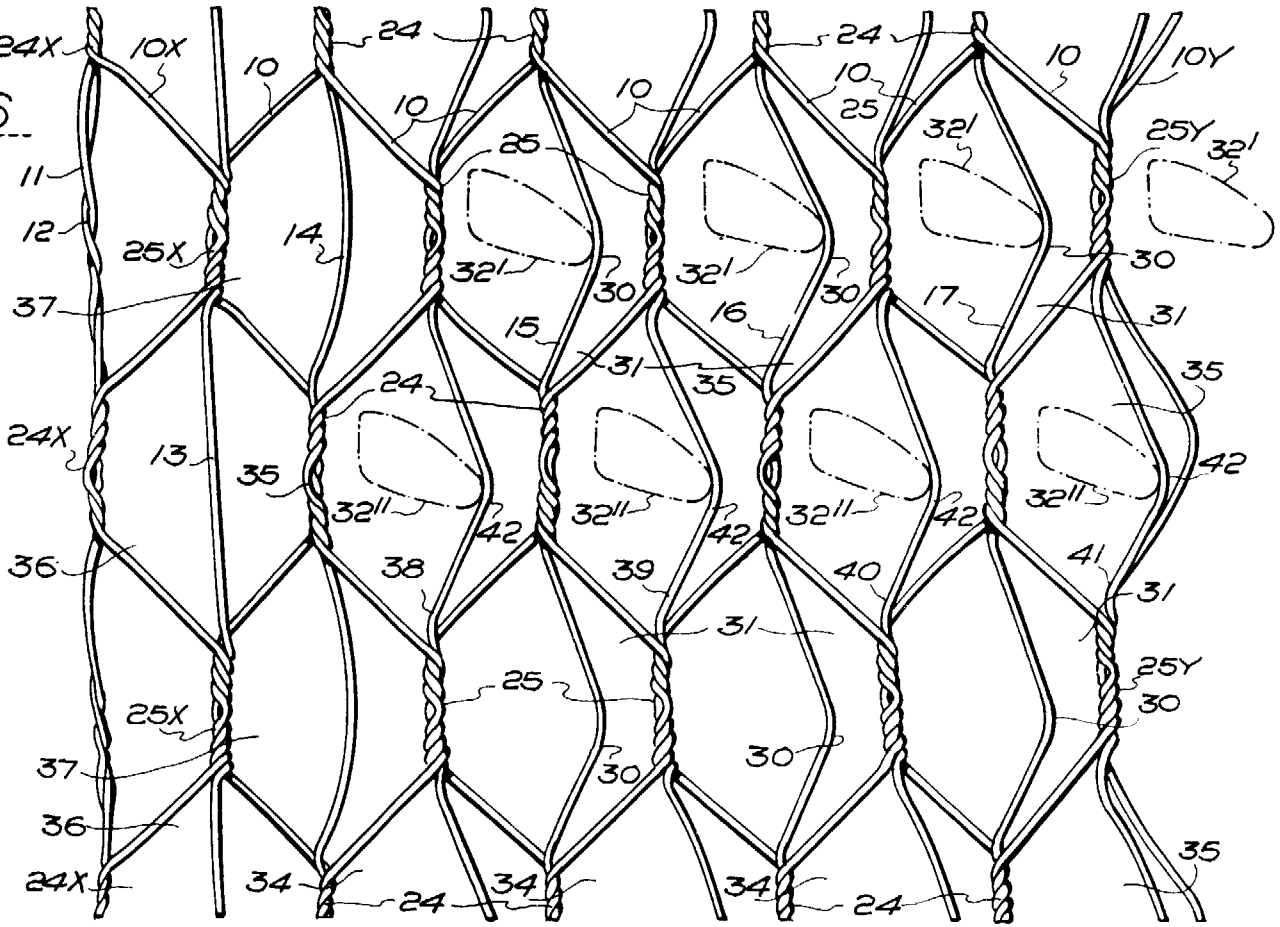
Figure 7:
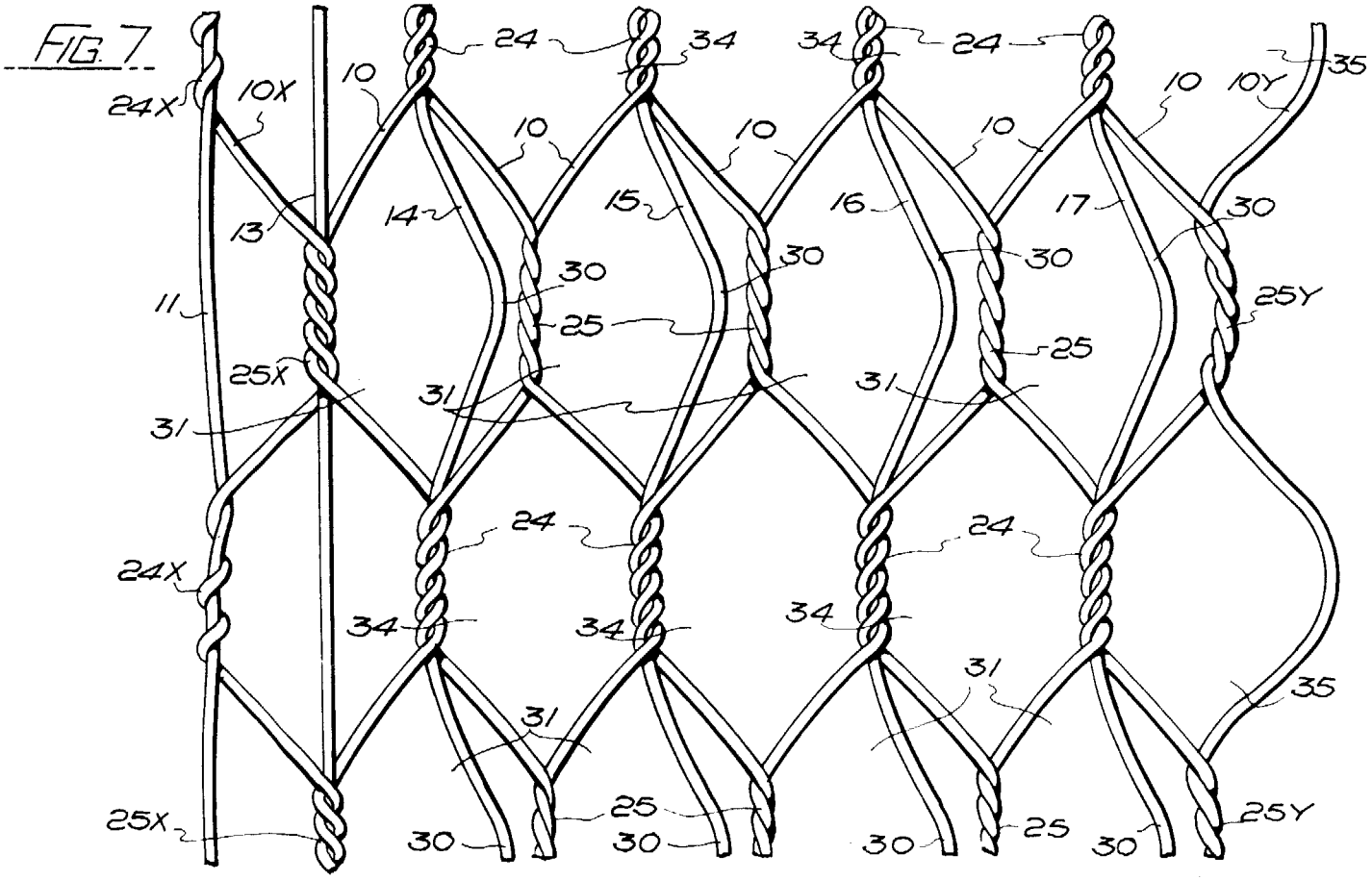

FIG. 6 corresponds to FIG. 1, but shows a modification in which the maximum weight of reinforcing wire is provided; and FIG. 7 also corresponds to FIG. 1, but shows an alternative form of wire netting in accordance with the invention.

Figure 2:
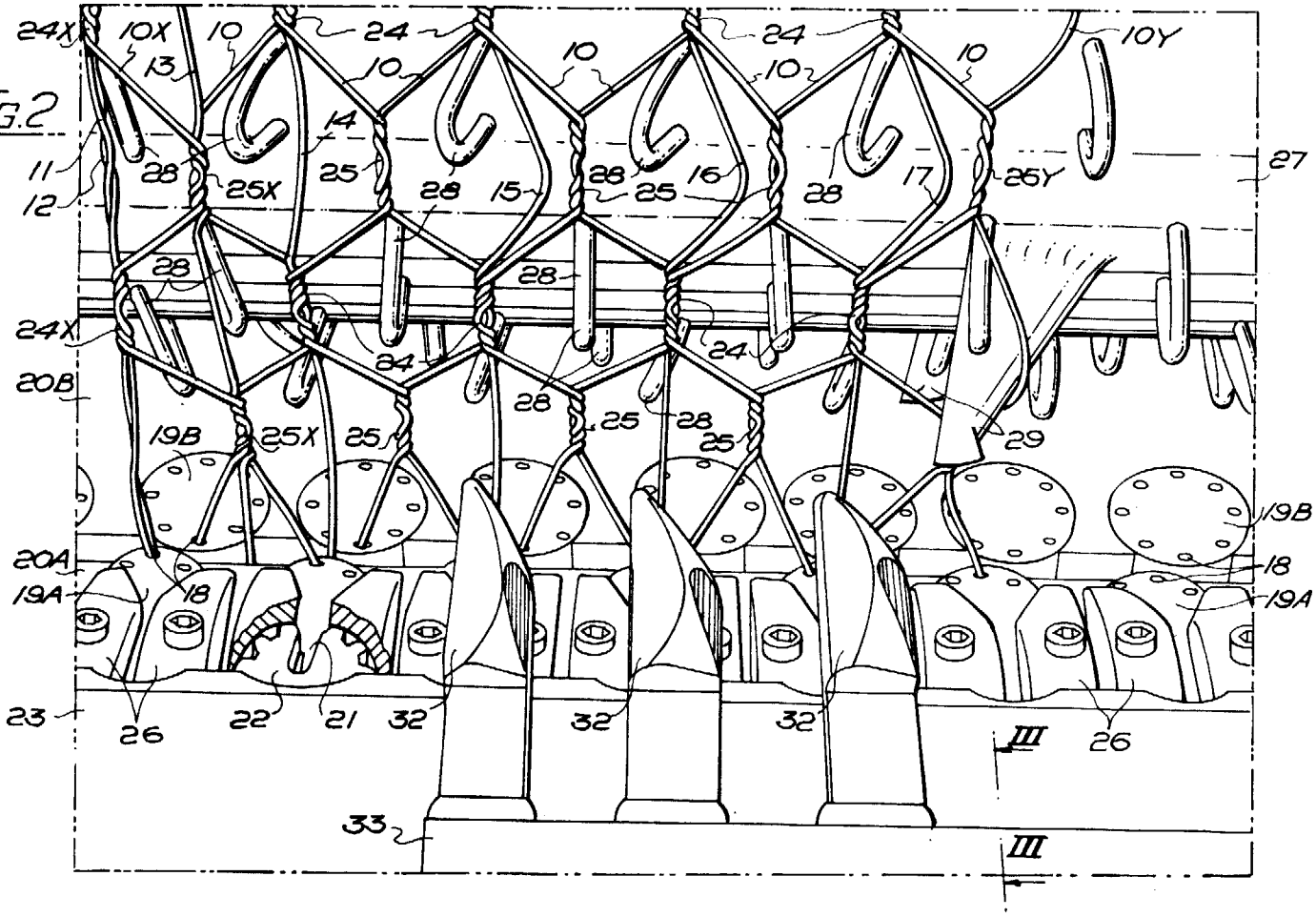
FIG. 2 is a fragmentary perspective view of a machine for forming wire netting as shown in FIG. 1.
Figure 3:
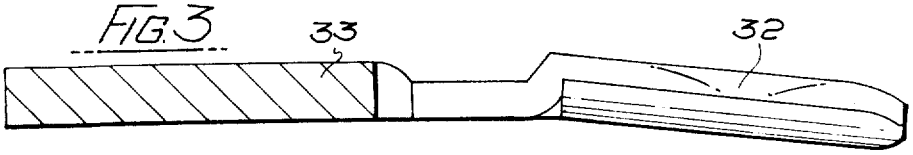
FIG. 3 is a fragmentary part sectional view taken from the line III — III in FIG. 2.
Figure 4:
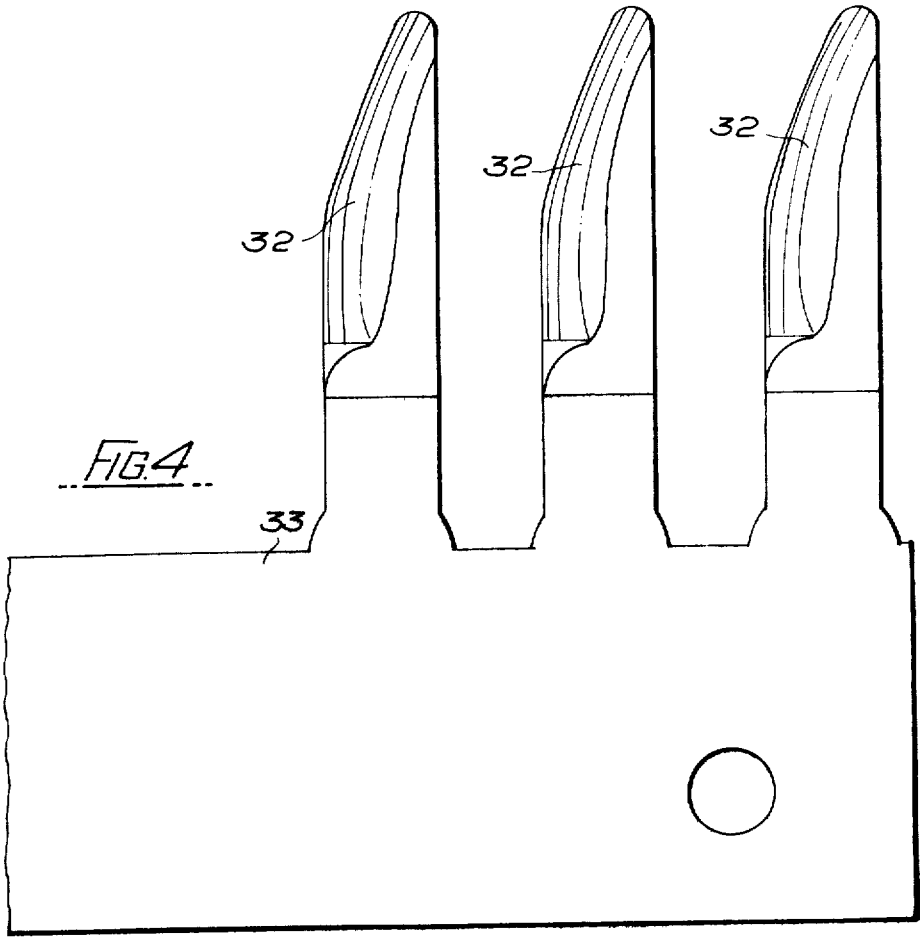
FIG. 4 is a fragmentary elevation taken from the underside of FIG. 3.
Figure 5:
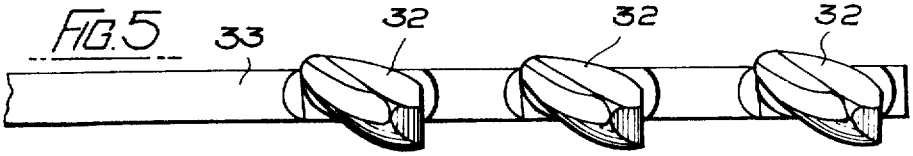
FIG. 5 is a fragmentary view taken from the top of FIG. 4.

In FIG. 1 wire netting of the reverse twist type is formed of mesh-forming wires 10; selvedge wires 11, 12 and line wires 13, 14, 15, 16, 17 on a well-known machine, such as that made by Wafios Maschinenfabrik and described in their British Patent Specification No. 418,735, parts of which can be seen in FIG. 2. The wires 10 are threaded through channels 18 in guides 19A, 19B in a pair of guide bars 20A, 20B adapted to reciprocate intermittently in opposition to bring each wire 10 into alignment with each of the adjacent wires 10 alternately, and while in alignment slots 21 in twisting pinions 22 (only one shown in FIG. 2) are brought into engagement with the wires and the pinions rotated to twist the wires 10 together. The twisting pinions are carried by a beam 23 which is also adapted to reciprocate intermittently between movements of the twisting pinions into and out of engagement with the aligned wires 10, whereby staggered rows of twists 24, 25 are formed with the wires 10 to create the netting.

The selvedge wires 11, 12 are guided together through a channel 18 in one of the guides 19A and an end wire 10Y at the edge remote from the selvedge wire is also guided through a channel 18 in one of the guides 19A. Each guide 19A, 19B is provided with eight channels 18 and is rotatably mounted in its respective guide bar 20A, 20B to enable a fresh channel to be brought to operative position in place of a worn channel. The selvedge wires 11, 12 are twisted with a mesh-forming wire 10X to make twists 24X in line with the twists 24, and the end wire 10Y is twisted with the adjacent mesh-forming wire 10 to make twists 25Y in line with the twists 25.

Tongues 26 extending from the beam 23 guide the aligned wires into the slots 21 in the pinions, and the formed mesh is carried away from the forming region by a roller 27 with pegs 28 formed by loops of rigid wire or rod, except for special end pegs 29 which engage the wire 10Y.

The line wire 13 extends through and is twisted into the twists 25X between the wire 10X and the adjacent mesh-forming wire 10, while the line wires 14, 15, 16, 17 extend through and are twisted into the twists 24. All the line wires are guided (by fixed guides, not shown, below the guide bars 20A, 20B) to pass between the guide bars and, when aligned with the wires 10, to pass between the guides 19A, 19B.

In accordance with the present invention, crimps 30 are formed in the line wires 15, 16, 17 by deflecting them between successive rows of longitudinally aligned twists 24 after forming the leading row of twists and before forming the following row of twists, whereby with these line wires held in the leading row of twists the longer lengths of line wires that would be required than what would extend straight across the meshes 31 are drawn into the mesh locations before the line wires become held in the following row of twists. The deflecting of the line wires 15, 16, 17 is in the plane of the wire netting, and is effected by a series of three tapering fingers 32 (FIGS. 2 to 5) extending from a plate 33 which is carried by the beam 23 that carries the twisting pinions 22 into and out of engagement with the aligned mesh-forming wires 10. The crimps 30 are all identical, being formed by deflecting the line wires 15, 16, 17 to the same extent by providing the fingers with the same width at the positions of ultimate deflection of the line wires, as indicated by the broken lines $32^{I}$ in FIG. 1. Alternate advance strokes of the fingers 32 towards the netting brings them into meshes 34 without any line wires, as indicated by the broken lines $32^{II}$ in FIG. 1. However, in FIG. 6, which will be referred to again presently, all the meshes are crossed by line wires and the one series of fingers is effective to deflect line wires in successive staggered rows of meshes.

During application of the wire netting to pipes it can be stretched, as by deflection of the netting by a roller or rollers, in known manner, or merely by greater tension at the right-hand edge of the netting during wrapping on to a rotating pipe, so as to cause straightening of the crimps 30 and elongation of the meshes 31, 34 (and edge meshes 35) progressively greater towards the wire 10Y, whereby that edge of the netting becomes effectively longer than the selvedge 11, 12 and can overlap it in a preceding turn round a pipe without further straightening of the crimps or stressing of the wires.

The line wire 13 through the twists 25X and meshes 36 is straight (i.e. non-crimped), so as to add further to the weight of reinforcing wire in the mesh-forming wires 10, the selvedge wires 11, 12 and the crimped line wires 15, 16, 17, where no extending of the wire netting is still acceptable during the wrapping of the netting simultaneously with spraying concrete on to a pipe. The other line wire 14 through the first longitudinal row of twists 24 and meshes 37 is allowed some slackness during formation of the netting so as to assume slight simulated crimps allowing of a little stretching of the netting at this location.

The shapes of the fingers 32 as depicted in FIGS. 2 to 5 have been developed so as to avoid any damage to the line wires 15, 16, 17, even though they are tensioned to an appreciable extent, by the usual loaded guide pulleys (not shown).

In FIG. 6 the maximum weight of reinforcing wire is provided by adding line wires 38, 39, 40, 41 through the twists 25, 25Y and across the meshes 34, 35, with crimps 42 formed by deflection of these line wires by the fingers 32 (now four in number) in their alternate advanced positions $32^{II}$.

In FIG. 7, continuous twist netting comprises mesh-forming wires 10, a single selvedge wire 11, and line wires 13, 14, 15, 16, 17 with staggered rows of twists 24, 25 formed with the wires 10 to create the netting, a wire 10X being twisted at 24X round the selvedge wire 11, and an end wire 10Y at the edge remote from the selvedge wire being tiwsted at 25Y with the adjacent mesh-forming wire 10. The line wire 13 extends through the twists 25X between the wire 10X and adjacent mesh-forming wire 10, while the line wires 14, 15, 16, 17 extend through the twists 24.

In accordance with the present invention, crimps 30 are formed in the line wires 14, 15, 16, 17 by deflecting them between successive rows of longitudinally aligned twists 24 after forming the leading row of twists and before forming the following row of twists, whereby with these line wires held in the leading row of twists the longer lengths of line wires that would be required than what would extend across the meshes 31 are drawn into the mesh locations before the line wires become held in the following row of twists. The deflecting of the line wires 14, 15, 16, 17 is in the plane of the wire netting, and can be effected by a series of four tapering fingers similar to the fingers 32 of FIGS. 2 to 5 carried by a continuous twist machine and reciprocating into and out of every other row of meshes 31.

Because in a continuous twist machine the twists (24, 25) are produced by rotating aligned guides together, instead of rotating aligned wires together, there is theoretically no limit to the size of wires that can be used in continuous twist netting, so a greater weight of reinforcing wire can be provided by increasing the diameter of the wire 10, 11, 13, 14, 15, 16, 17, but a maximum weight of reinforcing wire is again provided by adding line wires (not shown) through the twists 25 and across the meshes 34, 35, with crimps formed similarly by deflection of these additional line wires.

While in the netting of any one of FIGS. 1, 6, or 7 the line wires can be of higher tensile wire than the wires 10, such use of higher tensile wire is particularly suited to the netting of FIG. 7 as the line wires are not twisted with the mesh-forming wires in continuous twist netting; the mesh-forming wires are twisted round the line wires and grip them solely by friction.

I claim:

1. Reinforcement for concrete for covering pipes comprising wire netting with a straight selvedge wire along only one edge of the netting and with line wires extending through at least some twists of the netting, at least some of the line wires including the line wire remote from the selvedge wire being crimped in at least some of the meshes of the netting across which they extend.

2. Reinforcement as in claim 1, wherein the crimped line wires are crimped in all of the meshes of the netting across which they extend.

3. Reinforcement as in claim 1, wherein the wire netting is of the reverse twist type.

4. Reinforcement as in claim 1, wherein the wire netting is of the continuing twist type.

5. Reinforcement as in claim 1, wherein the line wires are of different quality metal to the wires twisted together to form the meshes.

6. Reinforcement as in claim 5, wherein the crimped line wires are formed of higher tensile wire than the wires twisted together to form the meshes.

7. Reinforcement as in claim 1 wherein the crimps are all identical.

8. Reinforcement as in claim 1, wherein the crimps become progressively greater in extent across the width of the wire netting.

9. Reinforcement as in claim 1, wherein the selvedge wire is duplicated.

10. Reinforcement as in claim 1, wherein a straight line wire is provided through the full meshes adjacent the selvedge wire.

11. Reinforcement as in claim 10, wherein another line wire is provided through the full meshes next-but-one to the selvedge wire and allowed some slackness during formation of the netting so as to assume slight simulated crimps.

12. A method of forming reinforcement for concrete for covering pipes, said reinforcement comprising wire netting with a straight selvedge wire along only one edge and with line wires extending through at least some twists of the netting, at least some of the line wires including the line wire remote from the selvedge wire being crimped in at least some meshes of the netting across which they extend, comprising the steps of guiding a wire along a straight path to form the selvedge wire; guiding the remote line wire in spaced apart relationship to the selvedge wire; twisting the selvedge wire with an adjacent mesh forming wire; forming longitudinally aligned twists among intermediate line wires and mesh wires; twisting the remote line wire with an adjacent mesh forming wire; and forming the crimps by deflecting the line wires between successive rows of longitudinally aligned twists after forming a leading row of twists but before forming a following row of twists.

13. A method as in claim 12, wherein the deflecting of the line wires is in the plane of the wire netting.

14. An apparatus for forming reinforcement for concrete for covering pipes, said reinforcement comprising wire netting with a straight selvedge wire along only one edge and with line wires extending through at least some twists of the netting, at least some of the line wires including the line wire remote from the selvedge wire being crimped in at least some meshes of the netting across which they extend, comprising means for guiding a wire in a straight line to form the selvedge wire; means for guiding the remote line wire spaced apart from said selvedge wire; first pinion means for twisting the selvedge wire with an adjacent mesh forming wire; second pinion means for twisting additional mesh forming wires along with line wires to form longitudinally aligned twists; third pinion means for twisting the remote line wire with an adjacent mesh forming wire; a beam for supporting said three pinion means and for guiding same into and out of engagement with the selvedge, line and mesh forming wires; and a series of tapered fingers carried by said beam and adapted to deflect line wire in successive, staggered rows of meshes.

15. The apparatus of claim 14, wherein said fingers are further adapted to deflect the line wires in the plane of the wire netting.

* * * * *